United States Patent [19]

Robins

[11] Patent Number: 4,834,334

[45] Date of Patent: May 30, 1989

[54] TURN AND TILT EASEL

[76] Inventor: Floyd D. Robins, 57 Miller La., Ponca City, Okla. 74601

[21] Appl. No.: 227,789

[22] Filed: Aug. 3, 1988

[51] Int. Cl.[4] ..... B43L 1/00

[52] U.S. Cl. ..... 248/.441.1; 108/6; 434/419

[58] Field of Search ..... 248/441.1, 447, 454, 248/457, 460, 122, 291, 185; 40/492, 486, 588; 434/408, 413, 414, 415, 419, 422; 108/6, 8

[56] References Cited

U.S. PATENT DOCUMENTS

| | | | |
|---|---|---|---|
| 413,679 | 10/1889 | Obergh | 434/419 |
| 640,687 | 1/1900 | McClung | 434/419 |
| 641,683 | 1/1900 | Evans | 434/419 |
| 682,761 | 9/1901 | Smith, Sr. . | |
| 1,015,498 | 1/1912 | Kraus | 434/419 |
| 1,652,774 | 12/1927 | Fraser | 108/8 |
| 1,907,780 | 5/1933 | Froelich | 108/6 |
| 1,989,216 | 1/1935 | Shaw | 434/408 |
| 2,775,424 | 12/1956 | Harris . | |
| 2,883,769 | 4/1959 | Jones | 434/419 |
| 2,931,602 | 4/1960 | Ferguson . | |
| 3,107,442 | 10/1963 | Levine | 434/419 |
| 3,148,461 | 9/1964 | Johnson | 434/419 |
| 4,084,699 | 4/1978 | Koepke | 211/88 |

FOREIGN PATENT DOCUMENTS

| | | | |
|---|---|---|---|
| 1123146 | 8/1968 | United Kingdom | 108/6 |

*Primary Examiner*—Ramon O. Ramirez
*Assistant Examiner*—Robert A. Olson
*Attorney, Agent, or Firm*—William J. Miller

[57] ABSTRACT

A turn and tilt easel has a box base which has parallel and oppositely spaced sides and a bottom. The easel is attached to the base and is formed of upwardly extending members which are pivotally attached at one end midway along the length of the base. The easel is formed with first and second writing surfaces attached between and on each side of the upwardly extending members to form writing surfaces on each side. The writing surfaces are attached above the upper surface of the base by an amount which will permit the easel to rotate about the pivotal attachment at least fifteen degrees from the vertical or normal to the surface of the base. In the preferred embodiment, one writing surface will comprise a chalkboard, while the remaining side will comprise a dry-wipe board. A handle may be attached to the top of the easel for ease in transportation from one location to another. The base face can be used for storing writing material, such as "Magic Markers" for the dry-wipe board or chalk for the chalkboard.

2 Claims, 1 Drawing Sheet

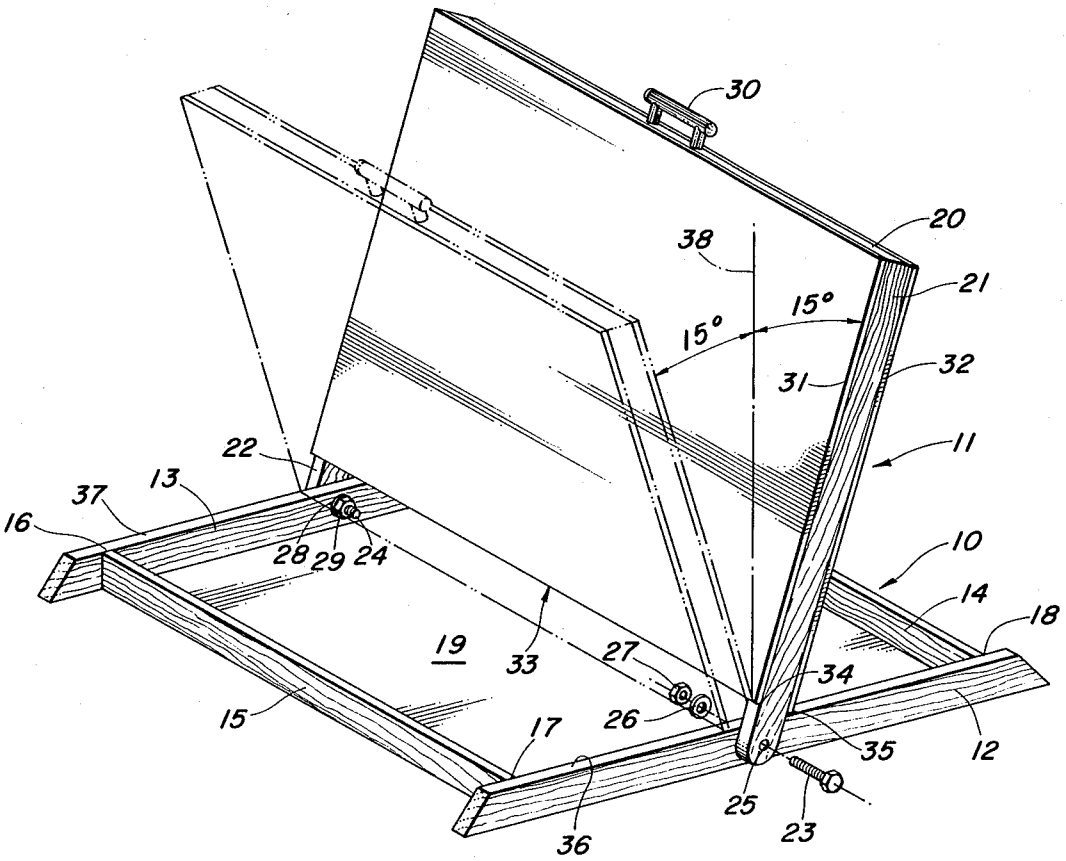
10
11
12
13
14
15
16
17
18
19
20
21
22
23
24
25
26
27
28
29
30
31
32
33
34
35
36
37
38
15°
15°

TURN AND TILT EASEL

BRIEF DESCRIPTION OF THE PRIOR ART

The best prior art known to Applicant is U.S. Pat. No. 2,775,424 issued to C. C. Harris, entitled "Adjustable Display Easel". This patent shows a base with a pivotally attached display surface which has indents used to limit the total movement of the display surface. It does not illustrate a writing surface, nor does it illustrate a double sided writing surface. Furthermore, the writing surface does not limit the total movement of the easel portion with respect to the base.

U.S. Pat. No. 2,931,602 issued to R. Ferguson, entitled "Mirror Mounting Mechanism" illustrates a method for pivotally attaching a mirror to a fixed upright member. It does not appear to relate to easels generally.

U.S. Pat. No. 682,761 issued to H. B. Smith, Sr., entitled "Book rest" illustrates a method for clamping a book rest to a table and does contain a pivotally attached book rest.

None of the above patents describe the novel easel arrangement disclosed herein.

BRIEF DESCRIPTION OF THE FIGURE

The FIGURE is a third dimensional view of the tilt easel with the alternate positions shown in dotted lines. The attachment bolt is shown in expanded view.

DETAILED DESCRIPTION OF THE SPECIFICATION

Referring to the FIGURE, an easel is illustrated which as a base referred to by an arrow 10 and an easel portion which is referred to by arrow 11. Base 10 generally comprises first and second side members 12 and 13 which are parallelly spaced and a second pair of end members 14 and 15 which are likewise parallelly spaced and attached at locations 16, 17 and 18 and a fourth location, not illustrated.

The general configuration of side portions 12 and 13 and end portions 14 and 15 form a box for holding writing portion 11. A bottom 19 is attached in any manner to side portions 12 and 13 and end portions 14 and 15, such as gluing, nailing or screwing bottom 19 to side portions 12 and 13 and end portions 14 and 15.

Easel portion 11 essentially comprises at least side portion 21 and 22. Both side portions which are pivotally attached at approximately the midpoint of sides 12 and 13, respectively, by means of bolts 23 and 24 which pass through holes or openings 25 and corresponding holes or openings, not shown in side portion 12. Bolt 24 likewise passes through holes or openings in parallelly spaced side portion 13 and side portion 22. Bolt 23 is attached to side portion 12 by means of a washer 26 and a nut 27. Bolt 24 is correspondingly attached by means of a washer 28 and a nut 29. An additional portion 20 may be attached between the ends of side portions 21 and 22 so that a handle 30 can be attached thereto.

A pair of writing surfaces 31 and 32 extend between parallelly spaced side portions 21 and 22 and are attached thereto. Writing surfaces 31 and 32 can also be attached to portion 20. There may likewise be an under portion 33 attached between side portions 21 and 22 in order to improve the stability of writing surfaces 31 and 32.

Writing surfaces 31 and 32 may be, for example, a chalkboard for surface 31 and a dry marking surface 32.

Dry marking surfaces are well known in the art and are generally used with a special "Magic Marker" that will write upon the surface and can then be easily erased with the proper erasing materials.

Of critical importance to this invention is the spacing between bottom edge 34 of writing surface 31 and bottom edge 35 of writing surface 32. These bottom edges 34 and 35, must be spaced above upper surface 36 of side portion 12 and upper surface 37 of side portion 13 so that marking portion 11 can be rotated plus or minus fifteen degrees from line 38 which is normal to upper surfaces 36 or 37 of side portions 12 and 13, respectively. Thus, side portions 21 and 22 can be rotated about bolts 23 and 24 until under portion 35 strikes upper portion 36, respectively, or under surface 34 strikes upper surface 36 or 37, respectively.

OPERATION

During the normal use of the easel, a user will receive the easel in a knocked down condition, that is the assembly or base 10 will be one portion and the easel portion 11 will be a second. The two are easily assembled by placing portions 21 and 22 so that holes 25 are aligned and bolt 23 is then inserted through holes 25 and through the corresponding hole in side portion 12 and washer 26 and nut 27 are then screwed onto bolt 23 until secure. The procedure applies to bolt 24 which is passed through a corresponding opening in side portion 22 and portion 13 with washer 28 and nut 29 screwed onto bolt 24 in a manner to secure bolt 24. The easel is then ready for use.

It will normally be tilted either in the position illustrated in heavy lines or can be rotated into the position illustrated by the dotted lines as the alternate position. Basically, if a person is to use the easel in the side illustrated by the heavy lines, writing surface 31 could, for example be a dry-wipe surface and crayons or the dry-wipe "Magic Markers" can be utilized upon the surface with relative ease. The dry-wipe surface can also be made of steel and magnetic letters or the like can be stuck to the surface if desired. If surface 32 is to be used, then handle 30 is grasped, the entire easel is rotated one hundred eighty degrees and the easel titled backward in the direction illustrated by the dotted lines. This will expose the chalkboard, for example, which would be surface 32, to view of the user whereupon chalk can also be used for marking upon the board. Chalk can also be stored in the side of base 19 closest to the chalkboard, while the "Magic Markers" etc. can be stored in the portion of base 19 closest to the dry-marking surface.

Not illustrated are dividers and separators in base 19 which could extend between side portions 12 and 13 along will dividers between ends 14 or 15. Thus, base 19 could be divided up into one or more sections in order to more easily confine the writing materials to the particular side where they are used or to prevent their intermixing during movement of the easel from one location to another.

CONCLUSIONS

This invention provides an extremely useful easel for a child or adult to use. The easel can be set on a table or on the floor and the child can scribe upon the easel using either surface to write upon. The bottom prevents the accumulation of chalk on the table or on the floor during its use and the bottom also prevents marking the surface with the writing materials, whether they are the "Magic Marker" or the chalk type if the either is dropped accidently during the time easel is being written upon.

It is obvious, of course, that the surfaces can also accommodate such things as cork for the insertion of thumb tacks for posting notices, pictures or paper and the like to be written upon. Furthermore, the metal dry-wall marker surface can be used to attach magnets thereupon which can also attach paper between the magnet and the metal surface which then can be easily marked or written upon, if desired, by the user. Thus, the invention clearly describes an extremely unique easel which provides a very versatile tool for the user.

It is obvious, of course, that other modifications can be made and still be well within the spirit and scope of this invention as described in the specifications and appended claims.

What I claim is:

1. A tilt easel comprising:

(a) a base comprising parallel members attached to form a box having a length, width and upper surface and lower surface;

(b) an easel comprising first and second members pivotally attached midway along the length of said base;

(c) first and second writing surfaces attached between said first and second pivotally attached members, each of said first and second writing surfaces having a top edge and a bottom edge, and wherein said bottom edge is spaced from said upper surface of said base so that said bottom edge will strike said upper surface when said first and second pivotally attached members are tilted about said pivot attachment point by at least fifteen degrees on either side of vertical with respect to the upper surface of said base; and, (d) wherein said box forming said base includes a bottom surface attached to said lower surface providing a storage location for writing materials and for collecting material dropped from said first and second writing surfaces.

2. Apparatus as claimed in claim 1 wherein one of said writing surfaces comprises a chalkboard and the remaining surface comprises a dry-wipe metal surface.

* * * * *